US008545264B2

(12) United States Patent
Nawa

(10) Patent No.: US 8,545,264 B2
(45) Date of Patent: Oct. 1, 2013

(54) CONNECTOR

(75) Inventor: Tetsuo Nawa, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/439,066

(22) Filed: Apr. 4, 2012

(65) Prior Publication Data

US 2012/0258623 A1 Oct. 11, 2012

(30) Foreign Application Priority Data

Apr. 11, 2011 (JP) ..... 2011-087236

(51) Int. Cl.
*H01R 13/40* (2006.01)

(52) U.S. Cl.
USPC ..... 439/587; 439/274

(58) Field of Classification Search
USPC ..... 439/587, 589, 595, 271–275
See application file for complete search history.

(56) References Cited

U.S. PATENT DOCUMENTS 5,145,410 A * 9/1992 Maejima et al. ..... 439/587
5,151,045 A * 9/1992 Cravens et al. ..... 439/271
5,573,429 A * 11/1996 Miyazaki et al. ..... 439/587
2008/0003876 A1 1/2008 Fukaya et al.
2010/0255703 A1 10/2010 Yoshioka et al.

FOREIGN PATENT DOCUMENTS

JP 2010-102943 5/2010

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A one-piece rubber plug (20) includes a main body (21) with insertion holes (24) and tubular projections (22) communicating with the insertion holes (24) and projecting from the rear surface of the main body (21). Restricting surfaces (36) matchable with restriction areas (25) on the outer peripheries of the tubular projections (22) are formed on through holes (33) of a rear holder (30). The rear holder (30) is displaced between a deformation permitting position where the restricting surfaces (36) are not in contact with the restriction areas (25) and where resilient radially expansive deformations of the tubular projections (22) are permitted and a deformation preventing position where radially expansive deformations of the tubular projections (22) are prevented by bringing the restricting surfaces (36) into contact with the restriction areas (25) substantially over the entire circumferences.

14 Claims, 6 Drawing Sheets

CONNECTOR

BACKGROUND OF THE INVENTION

1. Field of the Invention

The invention relates to a connector.

2. Description of the Related Art

Japanese Unexamined Patent Publication No. 2010-102943 discloses a connector including a housing formed with a plurality of terminal accommodating chambers. A one-piece rubber plug is mounted in a rear end portion of the housing and has seal holes corresponding to the terminal accommodating chambers. A rear member is brought into contact with the rear surface of the rubber plug to prevent the detachment of the rubber plug and has through holes corresponding to the seal holes. Terminal fittings are inserted from behind through the through holes and the seal holes and into the terminal accommodating chambers. Wires connected to rear end portions of the terminal fittings and disposed in the seal holes in a liquid-tight manner.

The rear member has front and rear slide plates with through holes disposed one over the other. The rear slide plate is slidable in a direction crossing an inserting direction of the wires. If the slide plates are slid, the rear member is switched to a wide open state where the rear and front through holes of the rear member are aligned to define a wide common opening and a narrow open state where the rear through hole deviates from the front through hole and the common opening area of the through holes becomes narrower.

The rear member is set in the wide open state when inserting the terminal fittings, and is displaced to the narrow open state after the terminal fittings are inserted. A bending force applied to the wires can displace the wires in a direction crossing the inserting direction of the terminal fittings and can enlarge the seal hole, with an adverse effect on sealing performance. However, the displacement amounts of the wires and the enlargement of the seal holes are suppressed when the rear member is displaced to the narrow open state, thereby preventing a reduction in sealing performance in response to a bending deformation of the wire.

Displacement of the wire in the bending direction is suppressed effectively in the above-described connector if the wire is bent in a direction to contact a part of the opening edge of the rear through hole located in the opening area on the front side. However, the displacement is not suppressed effectively if the wire is bent to approach a part of the opening edge of the rear through hole opposite the part located in the opening area on the front side.

The invention was completed in view of the above situation and an object thereof is to enable a displacement of a wire in a bending direction to suppressed effectively over substantially the entire circumference.

SUMMARY OF THE INVENTION

The invention relates to a connector with a housing that has at least one terminal accommodating chamber. A resilient member faces the rear surface of the housing and has at least one seal hole. A rear holder is configured to prevent a backward detachment of the resilient member from the housing and has at least one through hole substantially corresponding to the seal hole. At least one terminal fitting is inserted through the through hole and the seal hole and into the terminal accommodating chamber from behind. At least one wire is connected to the rear of the terminal fitting and is inserted into the seal hole in a fluid- or liquid-tight manner. The resilient member includes a main body with at least one insertion hole corresponding to the terminal accommodating chamber. At least one tubular projection projects from the rear surface of the main body and communicates with the insertion hole. The through hole is formed with at least one restricting portion that can match with a restriction area on the outer periphery of the tubular projection. The rear holder is displaceable between a deformation permitting position and a deformation preventing position. The deformation permitting position is reached by retracting the rear holder so that the restricting portion does not contact the restriction area, thereby permitting resilient radially expansive deformation of the tubular projection. The restricting portion contacts the restriction area over substantially the entire circumferences at the deformation preventing position to prevent radially expansive deformation of the tubular projection.

The terminal fitting can be inserted into the terminal accommodating chamber without a problem while the rear holder is at the deformation permitting position because the tubular projection can undergo radially expansive deformation. The rear holder is displaced to the deformation preventing position after the terminal fitting is inserted so that the restricting portion prevents radially expansive deformation of the tubular projection. Therefore, a displacement of the wire in a bending direction is suppressed over substantially the entire circumference.

The seal hole may extend along at least a part of an area from the front end of the insertion hole to the rear end of the tubular projection.

The restriction areas preferably are inclined with respect to the axis lines of the tubular projections.

The restricting portions preferably are displaced parallel to the axis lines of the tubular projections between the deformation permitting position and the deformation preventing position.

The tubular projections preferably are narrowed by the inclined restriction areas as the rear holder is displaced from the deformation permitting position to the deformation preventing position thereby preventing displacements of the wires in the bending direction.

The seal hole may extend along an area of the inner periphery of the tubular projection corresponding to the restriction area.

The restricting portions contact areas of the tubular projections where the seal holes are formed from the radially outer side when the rear holder is displaced to the deformation preventing position and prevent radially expansive deformations of the seal holes. Therefore, reliable sealing is provided between the seal holes and the wires.

An inner diameter of the restricting surface preferably is smallest at a rear end of the restricting surface, and an outer diameter of the tubular projection preferably is smallest at a rear end of the tubular projection.

A minimum inner diameter of the restricting surface preferably is slightly smaller than that of the tubular projection when the resilient member is not deformed.

An inner diameter of the restricting surface preferably is largest at a front end of the restricting surface and an outer diameter of the tubular projection preferably is largest at a front end of the tubular projection.

A maximum inner diameter of the restricting surface preferably is slightly smaller than that of the tubular projection when the resilient member is not deformed.

A dimension of the restricting surface and the tubular projection in forward and backward directions preferably are substantially equal.

A minimum inner diameter of the seal hole preferably is smaller than an outer diameter of the wire when the resilient member is not resiliently deformed.

These and other objects, features and advantages of the present invention will become more apparent upon reading of the following detailed description of preferred embodiments and accompanying drawings.

DETAILED DESCRIPTION OF THE PREFERRED EMBODIMENTS

Figure 1:
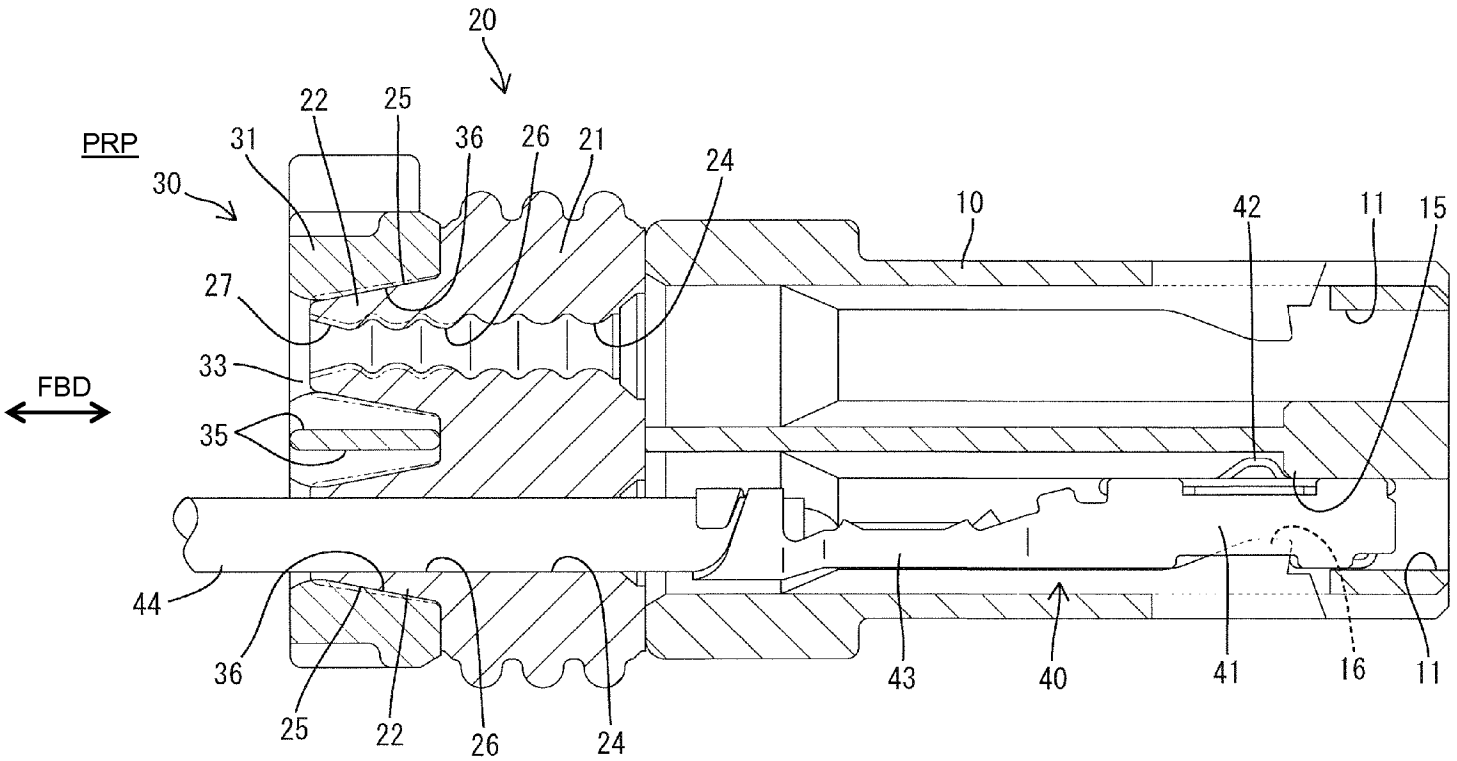
FIG. 1 is a section of a connector in accordance with an embodiment of the invention with a rear holder is at a deformation preventing position.
Figure 2:
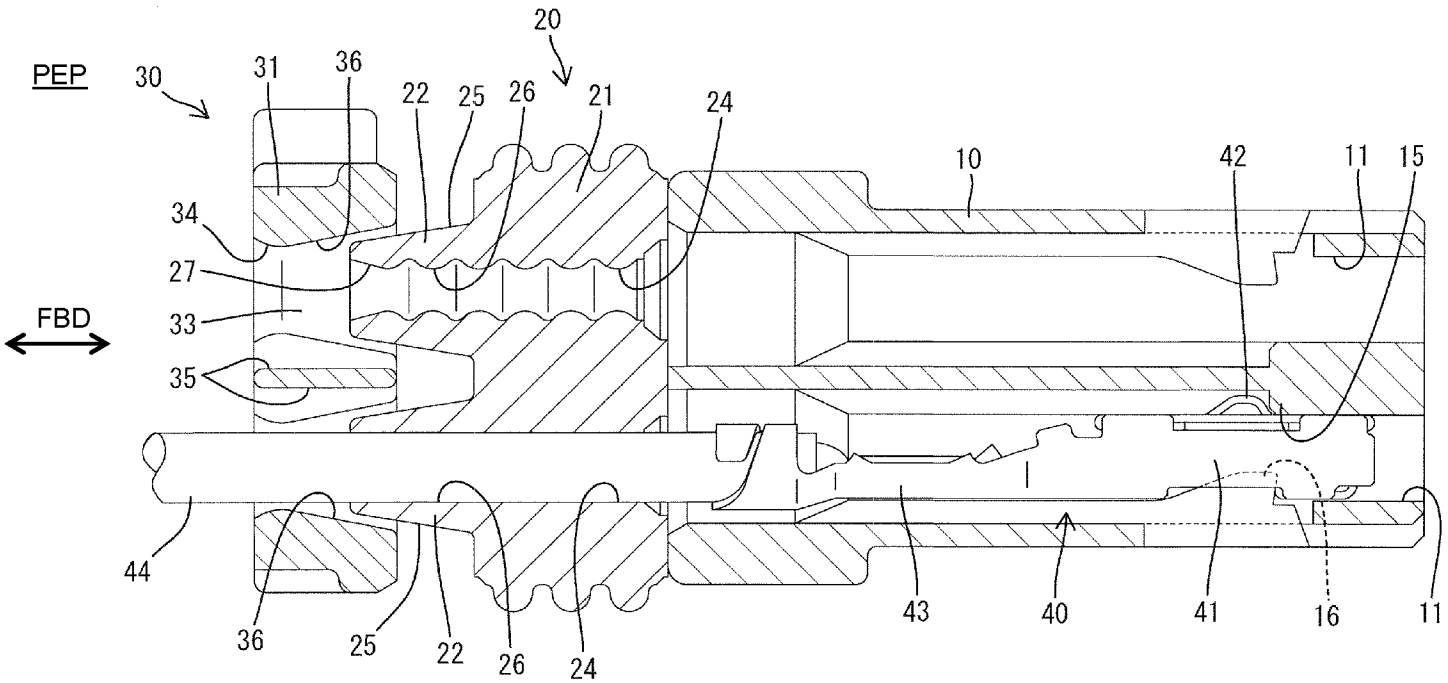
FIG. 2 is a section showing the rear holder at a deformation permitting position.

A connector in accordance with the invention includes a housing 10, a one-piece rubber plug 20, a rear holder 30, terminal fittings 40 and wires 44, as shown in FIGS. 1 and 2.

Figure 3:
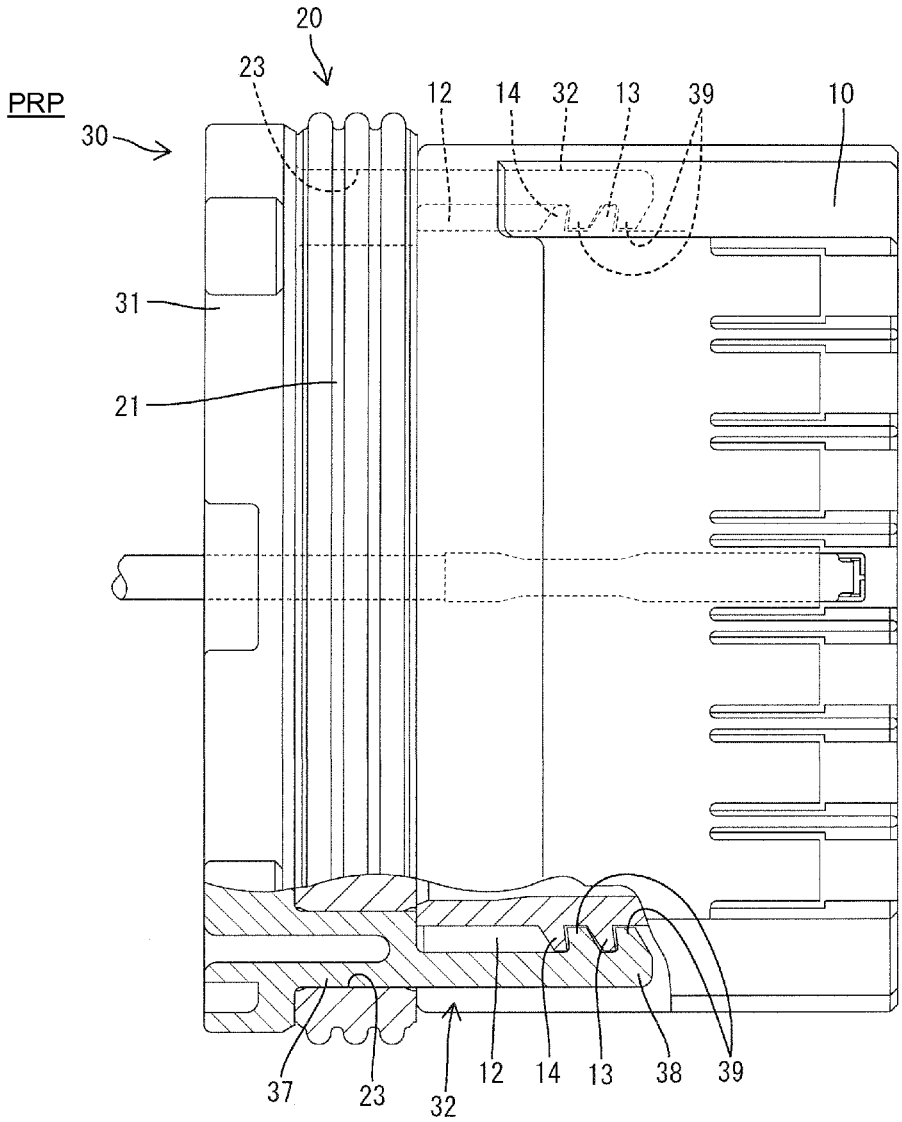
FIG. 3 is a plan view partly in section showing the rear holder at the deformation preventing position.
Figure 4:
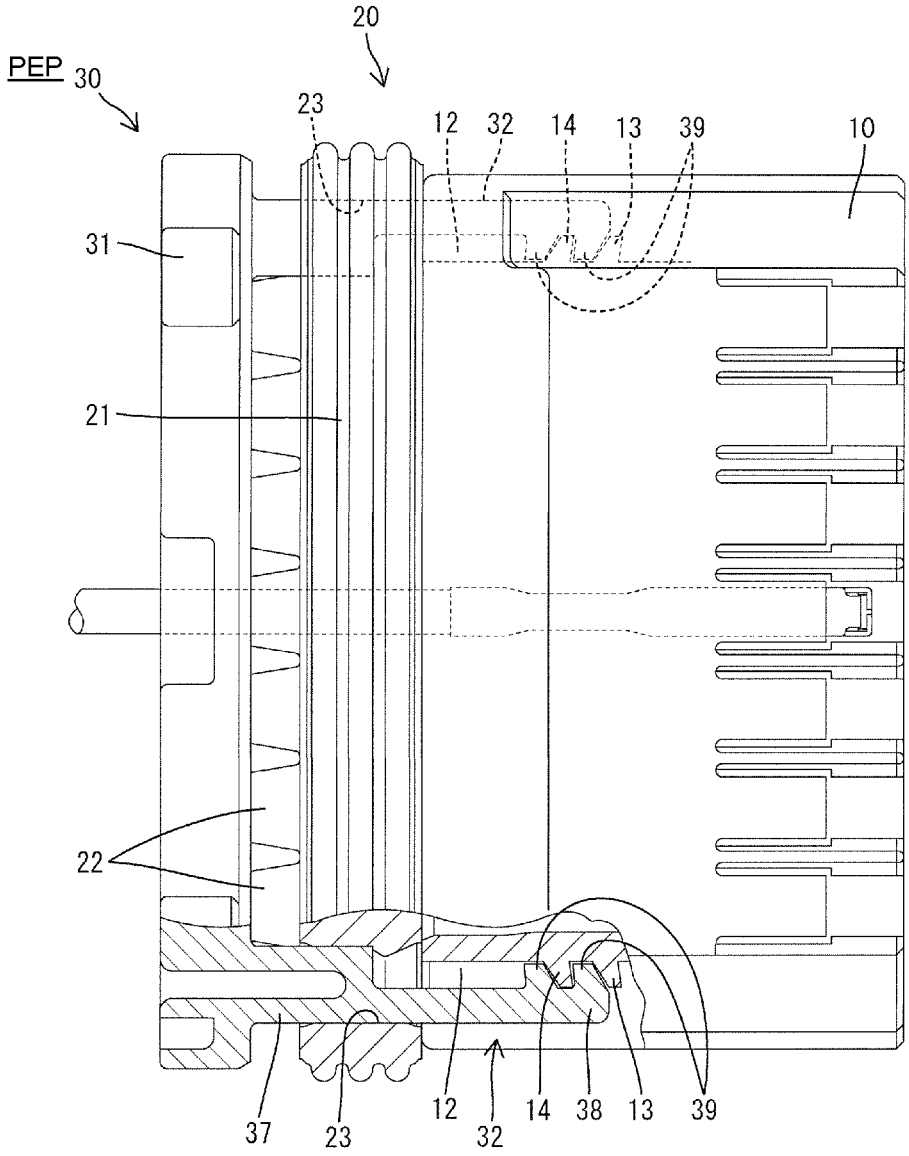
FIG. 4 is a plan view partly in section showing the rear holder at the deformation permitting position.

The housing 10 is made e.g. of synthetic resin and is substantially in the form of a wide block, as a whole as shown in FIGS. 1 to 4. Terminal accommodating chambers 11 penetrate through the housing 10 in forward and backward directions FBD at upper and lower levels and are arranged at regular intervals in a lateral direction, as shown in FIG. 1 and. The terminal accommodating chambers 11 in the upper level and those in the lower level are substantially vertically symmetrical. As shown in FIGS. 3 and 4, bilaterally symmetrical locking spaces 12 are formed by grooves in the left and right outer surfaces of the housing 10. Two first projections 13 and two second projections project out in the width direction in the locking spaces 12. The second projections 14 are behind the first projections 13.

Figure 5:
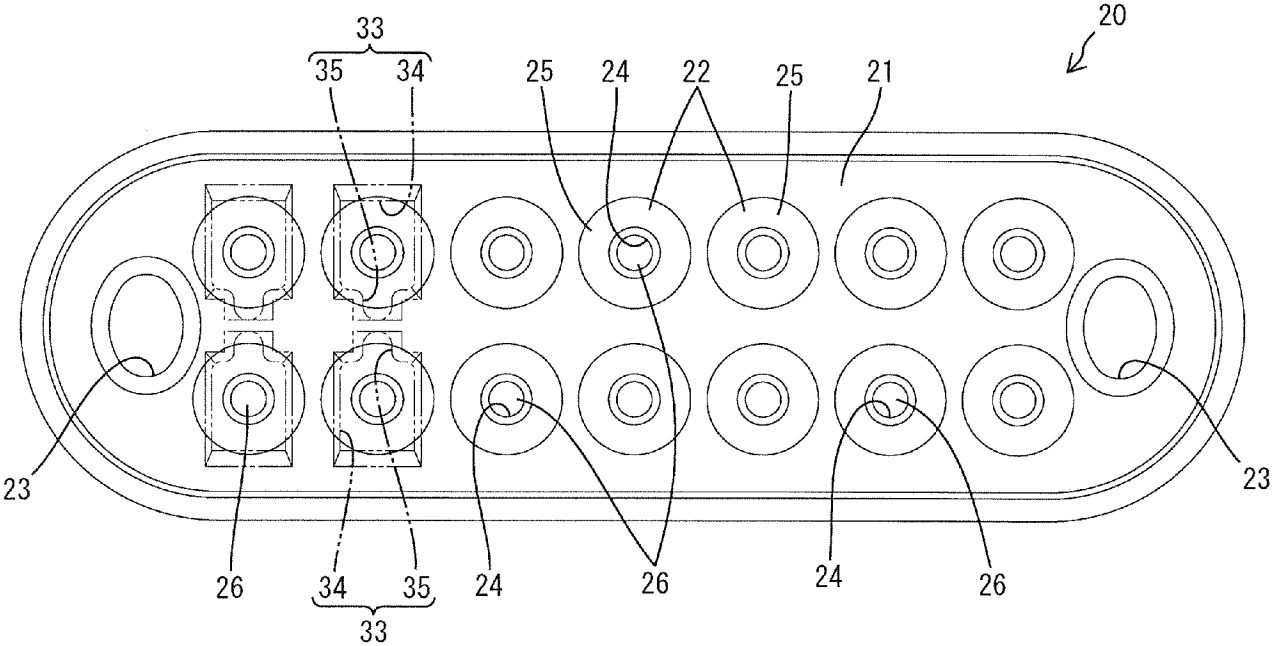
FIG. 5 is a rear view of a one-piece rubber plug.
Figure 6:
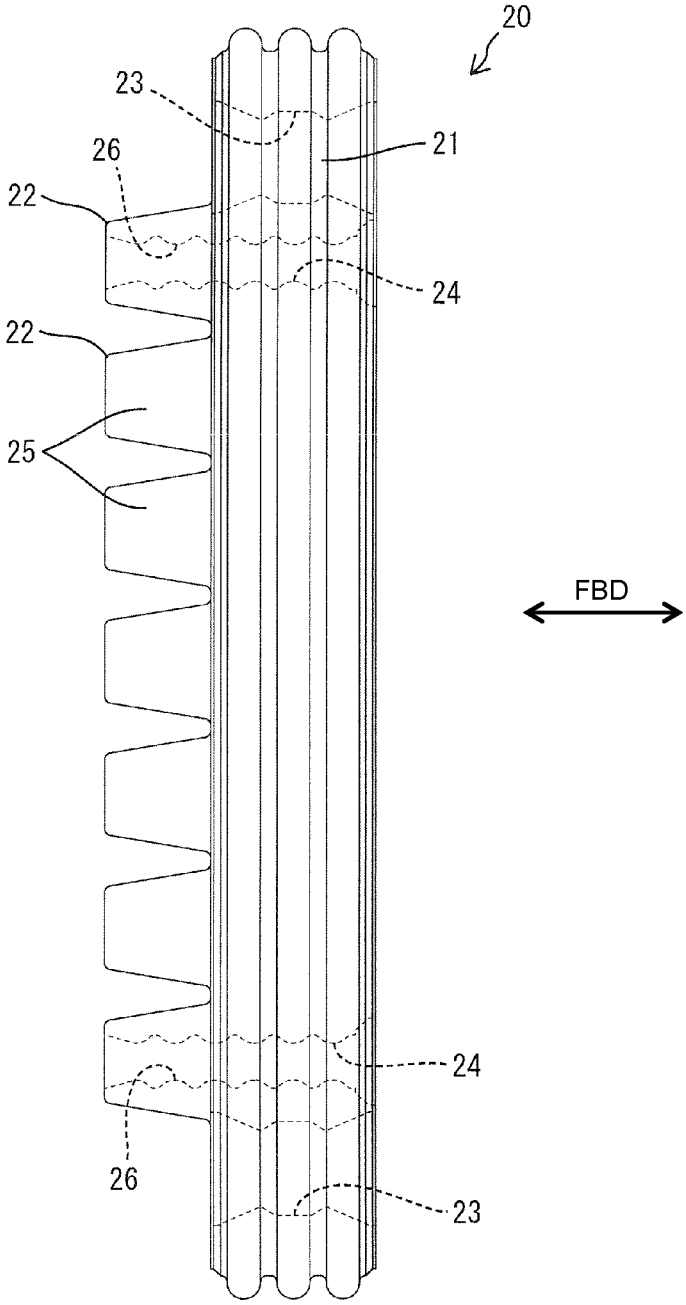
FIG. 6 is a plan view of the one-piece rubber plug.

The one-piece rubber plug 20 includes a main body 21 with an oval shape corresponding to the shape of the rear end surface of the housing 10, as shown in FIG. 5. Substantially conical tubular projections 22 project unitarily back from the rear surface of the main body 21, as shown in FIGS. 1, 2 and 6. Lips of known shape are formed on the outer periphery of the main body 21. As shown in FIGS. 3 to 6, positioning holes 23 penetrate through the left and right ends of the main body 21 and extend in forward and backward directions FBD. The positioning holes 23 are open in the front surface of the main body 21 and have a circular cross section. As shown in FIGS. 1, 2, 5 and 6, insertion holes 24 are formed in an area between the left and right positioning holes 23 of the main body 21 and are arranged in upper and lower levels at regular intervals in the lateral direction to correspond to the terminal accommodating chambers 11 of the housing 10.

As shown in FIGS. 1, 2 and 5, the tubular projections 22 are arranged to communicate coaxially with the insertion holes 24. As shown in FIGS. 1, 2 and 6, the entire outer peripheral surface of each tubular projection 22 defines a conical taper generated about an axis that extends in forward and backward directions FBD. The taper narrows gradually toward the back with an angle of inclination that is constant over the entire outer peripheral surface of the tubular projection 22. Thus, the outer peripheral surface of the tubular projection 22 defines smoothly continuous curve over the entire circumference and over the entire length. The tapered outer surface of the tubular projection 22 defines a restriction area 25 that achieves surface contact with a restricting surface 36 of the rear holder 30 to be described below.

Seal holes 26 penetrate through the main body 21 of the rubber plug 20 from the front surface of the main body 21 to the rear ends of the tubular projections 22, and hence include the insertion holes 24, as shown in FIGS. 1, 2, 5 and 6. Each seal hole 26 has a circular cross section with a minimum inner diameter less than the outer diameter of the wires 44 when the rubber plug 20 is not deformed. Further, as shown in FIGS. 1 and 2, a guiding surface 27 is formed at a rear end of each seal hole 26 and is widened toward the back.

The rear holder 30 is made unitarily e.g. of synthetic resin and includes a wall 31 with a wide oval shape similar to the shape of the main body 21 of the rubber plug 20 and two bilaterally symmetrical lock arms 32 that project forward from the left and right ends of the wall 31, as shown in FIGS. 3 and 4. Through holes 33 penetrate through the wall 31 in forward and backward directions FBD, as shown in FIGS. 1, 2 and 5, and are arranged to correspond to the tubular projections 22 and the seal holes 26. Specifically, the through holes 33 in the upper and lower levels are formed and positioned substantially vertically symmetrically.

An opening area of each through hole 33 in the upper level in the rear surface of the wall 31 (see FIG. 5) comprises a substantially rectangular area 34 and a cutout area 35 formed by partially cutting off the lower edge of the substantially rectangular opening. An opening area of each through hole 33 in the lower level in the rear surface of the wall 31 (see FIG. 5) comprises a substantially rectangular area 34 and a cutout area 35 formed by partially cutting off the upper edge of the substantially rectangular opening. The cutout areas 35 penetrate from the rear to the front of the wall 31.

As shown in FIGS. 1 and 2, at least one tapered area inclined with respect to forward and backward directions FBD is formed on the inner periphery of the through hole 33 except a rear end portion. This tapered area is narrowed toward the front, and an angle of inclination thereof in forward and backward directions FBD is substantially equal to the angle of inclination of the tapered outer peripheral surface (restriction area 25) of the tubular projection 22 that is not resiliently deformed. A surface of this tapered area where the cutout area 35 is not formed defines the restricting surface 36.

The inner diameter of the restricting surface 36 is smallest at the rear end of the restricting surface 36, and the outer diameter of the tubular projection 22 is smallest at the rear end of the tubular projection 22. The minimum inner diameter of the restricting surface 36 is slightly smaller than that of the tubular projection 22 in the state where the rubber plug 20 is not deformed. Further, the inner diameter of the restricting surface 36 particularly is largest at the front end of the restricting surface 36 and the outer diameter of the tubular projection 22 is largest at the front end of the tubular projection 22. The maximum inner diameter of the restricting surface 36 is slightly smaller than that of the tubular projection 22 in the state where the rubber plug 20 is not deformed. Further, a dimension of the restricting surface 36 in forward and backward directions FBD is substantially equal to that of the tubular projection 22 in forward and backward directions.

As shown in FIGS. 3 and 4, each lock arm 32 particularly includes a base 37 connected to the wall 31 and a resilient portion 38 cantilevered substantially forward from the projecting front of the base 37. Front and rear locks 39 project in from each of the left and right resilient portions 38.

Each terminal fitting 40 is a female terminal that is long and narrow in forward and backward directions, as shown in FIGS. 1 and 2. A substantially rectangular tube 41 is formed at a front end of the terminal fitting 40 and a stabilizer 42 projects from the outer surface of the rectangular tube 41. A wire crimping portion 43 is formed at a rear end of the terminal fitting 40 and is crimped, bent or folded into electrical connection with a front end portion of a wire 44.

The one-piece rubber plug 20 and the rear holder 30 are assembled by inserting the left and right lock arms 32 into the positioning holes 23 from behind. The assembly of the one-piece rubber plug 20 and rear holder 30 then is mounted into the rear end of the housing 10. At this time, the lock arms 32 enter the locking spaces 12 and the locks 39 engage the second projections 14, as shown in FIG. 4. Thus, the locks 39 sandwich the second projections 14 from front and rear ends to hold the rear holder 30 at a partial locking position on the housing 10. An assembling direction of the rear holder 30 into the housing 10 is parallel to the axis lines of the tubular projections 22.

The one-piece rubber plug 20 then is displaced forward relative to the rear holder 30 along the base end portions 37. As shown in FIGS. 2 and 4, the front surface of the main body 21 of the rubber plug 20 is brought into substantially surface contact with the rear surface of the housing 10 where the terminal accommodating chambers 11 are open and the respective insertion holes 24 (seal holes 26) correspond to the terminal accommodating chambers 11. The displacement direction of the one-piece rubber plug 20 is substantially parallel to the axis lines of the tubular projections 22.

The rear holder 30 is at a deformation permitting position PEP retracted back from the rubber plug 20 when the one-piece rubber plug 20 contacts the rear surface of the housing 10. Thus, the restricting surfaces 36 of the rear holder 30 are not in contact with the restriction areas 25 on the outer peripheral surfaces of the tubular projections 22 and clearances (deformation spaces) are formed between the outer peripheries of the tubular projections 22 and the restricting surfaces 36. Therefore the tubular projections 22 can be deformed resiliently to expand radially.

The terminal fittings 40 then are inserted into the terminal accommodating chambers 11 from behind. More particularly, the stabilizers 42 align with the cutout area 35 so that the rectangular tubes 41 enter the through holes 33 and are pushed farther into the interior seal hole 26 of the tubular projection 22. At this time, the tubular projection 22 is deformed resiliently to expand radially. Further, rear parts of the tubular projections 22 are surrounded over the entire circumference by the restricting surface 36. Thus, the tubular projections 22 will not deformed improperly in a direction crossing the axis line thereof.

The stabilizer 42 contacts a stopper 15 when the terminal fitting 40 reaches a proper insertion position in the terminal accommodating chamber 11. Thus, the terminal fitting 40 is stopped at its front end position and is retained by the locking action of a locking lance 16. Further, the wire 44 is passed through the seal hole 26, thereby providing fluid- or liquid-tight sealing between the inner periphery of the seal hole 26 and the outer periphery of the wire 44.

The rear holder 30 is pushed forward when all of the terminal fittings 40 have been inserted, thereby bringing the front surface of the wall 31 of the rear holder 30 into substantially surface contact with the rear surface of the main body 21 of the rubber plug 20, as shown in FIGS. 1 and 3. Thus, as shown in FIG. 3, the locks 39 engage and sandwich the corresponding front projections 13 from front and rear sides to prevent relative displacements of the rear holder 30 in forward and backward directions FBD with respect to the housing 10 and to prevent a backward detachment of the rubber plug 20 from the housing 10. Further, the base ends 37 of the lock arms 32 are inserted in the positioning holes 23 in a fluid- or liquid-tight manner.

In this way, as shown in FIG. 1, the rear holder 30 is arranged at a deformation preventing position PRP where the restricting surfaces 36 are in contact with the restriction areas 25. With the rear holder 30 located at the deformation preventing position PRP, the restricting surfaces 36 are held continuously in surface contact with the restriction areas 25 (tubular projections 22) from the front ends to the rear ends and over substantially the entire circumferences of the restriction areas 25. This contact of the restricting surfaces 36 prevents resilient deformations of the tubular projections 22 from the front ends to the rear ends of the tubular projections 22.

A part of the wire 44 drawn out backward from the rear holder 30 may be subjected to a bending force in a vertical or lateral direction crossing the axis of the seal hole 26. However, this bending force will not deform tubular projection 22. More particularly, the wire 44 subjected to the bending force presses the tubular projection 22 at its rear end having the smallest thickness, but the tubular projection 22 is hardly squashed. Accordingly, a bending force on the wire 44 will not displace the wire 44 in a bending direction and will not deform the tubular projection 22. Hence, a sealed state between the wire 44 and the seal hole 26 is not impaired by a bending force on the wire.

As described above, the rubber plug 20 of the connector includes the main body 21 with insertion holes 24 corresponding to the terminal accommodating chambers 11 and tubular projections 22 projecting from the rear surface of the main body 21 and communicating with the insertion holes 24. Seal holes 26 extend from the front ends of the insertion holes 24 to the rear ends of the tubular projections 22. On the other hand, the through holes 33 in the rear holder 30 have the restricting surfaces 36 matched with the restriction areas 25 on the outer peripheries of the tubular projections 22. The rear holder 30 is displaceable between the deformation permitting position PEP where the restricting surfaces 36 are not in contact with the restriction areas 25 and the tubular projections 22 can expand radially and the deformation preventing position PRP where the restricting surfaces 36 contact the restriction areas 25 over substantially the entire circumferences to prevent radially expansive deformations of the tubular projections 22.

According to this configuration, the tubular projections 22 can expand radially when the rear holder 30 is at the deformation permitting position PEP so that the terminal fittings 40 can be inserted into the terminal accommodating chambers 11 without a problem. On the other hand, the restricting surfaces 36 prevent the tubular projections 22 from expanding radially when the rear holder 30 is displaced to the deformation preventing position PRP. Thus displacements of the wires 44 in the bending direction can be suppressed effectively over substantially the entire circumferences.

The restriction areas 25 are inclined to the axes of the tubular projections 22 and the restricting surfaces 36 are displaced parallel to the axes of the tubular projections 22 (in forward and backward directions FBD) between the deformation permitting position PEP and the deformation preventing position PRP. Accordingly, the tubular projections 22 are narrowed by the inclined restriction areas 25 if the rear holder 30 is displaced from the deformation permitting position PEP to the deformation preventing position PRP to prevent displacements of the wires 44 in the bending direction.

Seal holes 26 are defined at areas of the inner peripheries of the tubular projections 22 corresponding to the restriction areas 25. According to this configuration, if the rear holder 30 is displaced to the deformation preventing position PRP, the restricting surfaces 36 contact radially outer surface areas of the tubular projections 22 where the seal holes 26 are formed to prevent radially expansive deformations of the seal holes 26 and to assure reliable sealing between the seal holes 26 and the wires 44.

The invention is not limited to the above described embodiment. For example, the following embodiments also are included in the scope of the invention.

The restriction areas on the outer peripheries of the tubular projections are tapered with respect to the axes of the tubular projections in the above embodiment. However, they may be parallel to the axes of the tubular projections. In this case, the front ends of the restricting portions of the rear holder may be behind the rear ends of the tubular projections at the deformation permitting position.

The angle of inclination of the taper on the outer periphery of the tubular projection is constant in the above embodiment. However, the outer periphery of the tubular projection may comprise plural tapered areas with different angles of inclination.

The entire outer periphery of the tubular projection is tapered in the above embodiment. However, the taper may be on only part of the outer periphery of the tubular projection in a circumferential direction or in forward and backward directions.

The restriction area is continuous in the entire area of the tubular projection in forward and backward directions in the above embodiment. However, the restriction area may be on only a part of the tubular projection in forward and backward directions.

The outer periphery of the tubular projection is a curved surface smoothly continuous over the entire circumference in the above embodiment. However, a part of the outer periphery of the tubular projection in the circumferential direction may project and this projecting part may function as the restriction area.

The outer periphery of the tubular projection is a smoothly curved continuous surface over the entire length in the above embodiment, but a part of the outer periphery of the tubular projection in forward and backward directions may project and this projecting part may function as the restriction area.

The entire area from the front end of the insertion hole to the rear end of the tubular projection is the seal hole in the above embodiment. However, the seal hole may only be a part of the area from the front end of the insertion hole to the rear end of the tubular projection (e.g. only the insertion hole or only the interior of the tubular projection).

The rear holder is a single part and is displaced parallel to the axes of the tubular projections in the above embodiment. However, the rear holder may have a divided structure and be displaced in a direction crossing the axes of the tubular projections.

The restriction areas and the restricting portions are in surface contact when the rear holder is at the deformation preventing position in the above embodiment. However, the restriction areas and the restricting portions may be in line or point contact when the rear holder is at the deformation preventing position.

Although the angle of inclination of the restricting portion is substantially equal to that of the restriction area in the above embodiment, it may be different from the angle of inclination of the restriction area.

What is claimed is:

1. A connector, comprising:

a housing with at least one terminal accommodating chamber;

a resilient member facing a rear surface of the housing and formed with at least one seal hole;

a rear holder with at least one through hole corresponding to the seal hole and configured to prevent a backward detachment of the resilient member from the housing;

at least one terminal fitting inserted through the through hole and the seal hole and into the terminal accommodating chamber from behind; and at least one wire connected to a rear end portion of the terminal fitting and inserted into the seal hole in a fluid- or liquid-tight manner, wherein:

the resilient member includes a main body with at least one insertion hole corresponding to the terminal accommodating chamber and at least one tubular projection communicating with the insertion hole and projecting from a rear surface of the main body;

the through hole is formed with at least one restricting portion matchable with a restriction area on the outer periphery of the tubular projection; and the rear holder is displaceable between a deformation permitting position where the restricting portion is not in contact with the restriction area and where resilient radially expansive deformation of the tubular projection is permitted and a deformation preventing position where the restricting portion contacts the restriction area over substantially the entire circumferences to prevent radially expansive deformation of the tubular projection.

2. The connector of claim 1, wherein the seal hole extends from a front end of the insertion hole to a rear end of the tubular projection.

3. The connector of claim 1, wherein the restriction area is inclined with respect to an axis of the tubular projection.

4. The connector of claim 3, wherein the restricting portion is displaced parallel to the axis of the tubular projection between the deformation permitting position and the deformation preventing position.

5. The connector of claim 1, wherein the seal hole extends along an area of the inner periphery of the tubular projection corresponding to the restriction area.

6. The connector of claim 1, wherein an inner diameter of the restricting surface is smallest at a rear end of the restricting surface, and wherein an outer diameter of the tubular projection is smallest at a rear end of the tubular projection.

7. The connector of claim 1, wherein a minimum inner diameter of the restricting surface is slightly smaller than a minimum inner diameter of the tubular projection in a state where the resilient member is not resiliently deformed.

8. The connector of claim 1, wherein an inner diameter of the restricting surface is largest at a front end of the restricting surface and/or wherein an outer diameter of the tubular projection is largest at a front end of the tubular projection.

9. The connector of claim 1, wherein a maximum inner diameter of the restricting surface is slightly smaller than a maximum outer diameter of the tubular projection when the resilient member is not resiliently deformed.

10. The connector of claim 1, wherein a dimension of the restricting surface in forward and backward directions is substantially equal to that of the tubular projection in forward and backward directions.

11. The connector of claim 1, wherein a minimum inner diameter of the seal hole is smaller than an outer diameter of the wire when the resilient member is not deformed.

12. A connector, comprising:

a housing with opposite front and rear ends and terminal accommodating chambers extending between the ends;

a resilient member having a front surface contacting the rear end of the housing and a rear surface opposite the front surface, the rear surface having tapered projections projecting rearward from the rear surface at locations aligned respectively with the terminal accommodating chambers, seal holes extending through the resilient member from the tapered projections to the front surface and aligned respectively with the terminal accommodating chambers so that the tapered projections define tapered tubes; and a rear holder mounted at the rear end of the housing to prevent a backward detachment of the resilient member from the housing, the rear holder being formed with through holes aligned respectively with the seal holes, front ends of the through holes defining restricting surfaces with tapered concave shapes configured for nesting with the respective tapered projections of the resilient member, the rear holder being movable between a rearward position where the restricting surfaces are not in contact with the tapered projections and a forward position where the restricting surfaces closely nest with the tapered projections to prevent radially expansive deformation of the tapered projections.

13. The connector of claim 12, wherein maximum inner diameters of the restricting surfaces are slightly smaller than maximum outer diameters of the tapered projections when the resilient member is not resiliently deformed.

14. The connector of claim 12, wherein a dimension of the restricting surfaces in forward and backward directions are substantially equal to that of the tubular projections in forward and backward directions.

* * * * *